US006666601B1

(12) United States Patent
Bingham et al.

(10) Patent No.: US 6,666,601 B1
(45) **Date of Patent: *Dec. 23, 2003**

(54) PRINT MEDIA LOADER

(75) Inventors: Jeffrey G. Bingham, Vancouver, WA (US); Brian D. Hemmerlin, Vancouver, WA (US); Eric L. Gasvoda, Salem, OR (US); Carl D. Beckett, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 196 days.

This patent is subject to a terminal disclaimer.

(21) Appl. No.: 09/666,252

(22) Filed: Sep. 21, 2000

(51) Int. Cl.[7] ..... B41J 11/58
(52) U.S. Cl. ..... 400/624; 400/642
(58) Field of Search ..... 400/624, 633, 400/633.2, 642, 647, 605; 271/9.09

(56) References Cited

U.S. PATENT DOCUMENTS 4,017,181 A * 4/1977 Komaba et al. ..... 271/127
5,000,596 A * 3/1991 Naruki ..... 400/625
5,091,754 A * 2/1992 Abe et al. ..... 355/317
5,116,034 A * 5/1992 Trask et al. ..... 271/2
5,177,544 A * 1/1993 Kimura et al. ..... 400/624
5,287,164 A * 2/1994 Watanabe ..... 399/391
5,346,197 A * 9/1994 Takano et al. ..... 271/9
5,599,120 A * 2/1997 Conrad et al. ..... 400/624
5,746,528 A * 5/1998 Mayer et al. ..... 400/625
5,957,447 A * 9/1999 Sekine ..... 271/9.09
6,179,499 B1 * 1/2001 Bertta et al. ..... 400/605

* cited by examiner

*Primary Examiner*—Anthony H. Nguyen

(57) ABSTRACT

A printer is provided with a media loader insert for removable insertion into an input tray of the printer. The media loader insert includes an insert body which defines a reduced-size media receptacle configured to receive small-size media for insertion into the printer input port. The insert body has a width corresponding to the width of letter-size paper, and thus is sized to fit securely within a conventional input tray. A width adjuster is provided adjacent the reduced-size media receptacle, the width adjuster being positioned centrally along a side edge of the reduced-size media receptacle to centrally engage a side edge of media within the reduced-size media receptacle, thereby reducing media skew.

17 Claims, 2 Drawing Sheets

PRINT MEDIA LOADER

TECHNICAL FIELD

The present invention relates generally to printers, and more particularly, to a media loader for use in a printer. More particularly still, the invention concerns an adjustable media loader insert for placement in an input tray of a printer to accommodate input of small-size media into the printer for printing.

BACKGROUND ART

Although printers typically are used to print on media of various media sizes, most printers have a maximum media width capacity, and correspondingly, a minimum media width on which effective printing can be accomplished. Some printers, such as high speed laser printers, provide dedicated input media trays for each media size. Lower cost printers, such as mass-market inkjet printers, generally have only one tray, typically accommodating letter-size media (8.5"×11"), with some adaptability to accommodate printing on media of different sizes.

In order to accommodate printing on media of different width media, printers often employ adjustable media edge stops that slide to constrain the side edges of narrower media sheets. Printing on media shorter than standard letter-size length normally is accommodated by feeding a stack of the shorter media into an input tray until its leading edge abuts a stop. While this has proven workable in some instances to accommodate envelopes and smaller index cards, there have been disadvantages to this approach.

Some printers, for example, have input trays that are not removable, and which extend well into the body of the printer. This leaves a significant distance between the media insertion aperture and the leading edge stop. It thus may be difficult to load or extract media which is shorter than this distance. Furthermore, it may be difficult to adjust the media edge stop in a manner necessary to maintain the media in its proper lateral position.

A further difficulty in accommodating smaller media sizes is that many printers rely on a common media registration scheme, such as using one edge of a media tray as a fixed side edge reference for all media sizes. Any measures to accommodate smaller media that do not provide contact with this reference surface will require printer firmware changes, generating cost and complexity disadvantages.

Additionally, even printers which do overcome problems with loading smaller media may not be adequately adjustable in width, leading to problems of unacceptable media skew. For example, media edge stops typically are adapted to engage a central region of standard size media sheets, laterally biasing the media in order to maintain proper input stack orientation. It will be appreciated, however, that smaller media typically is engaged nearer a trailing end of the media, potentially skewing the media as it enters the insertion aperture. This may be exacerbated as the input tray floor pivots upward, making it difficult to maintain a lateral biasing force on the input media stack.

SUMMARY OF THE INVENTION

The present invention addresses difficulties associated with printing on small-size media such as A6 media and Hagaki media by employing a media loader insert for removable insertion into an input tray of a printer. The media loader insert includes an insert body which defines a reduced-size media receptacle configured to receive small-size media for insertion into the printer input port. The insert body has a width corresponding to the width of letter-size paper, and thus is sized to fit securely within a conventional input tray. A width adjuster is provided adjacent the reduced-size media receptacle, the width adjuster being positioned centrally along a side edge of the reduced-size media receptacle to centrally engage a side edge of media within the reduced-size media receptacle, thereby reducing media skew.

DETAILED DESCRIPTION OF THE DEPICTED EMBODIMENT

Figure 1:
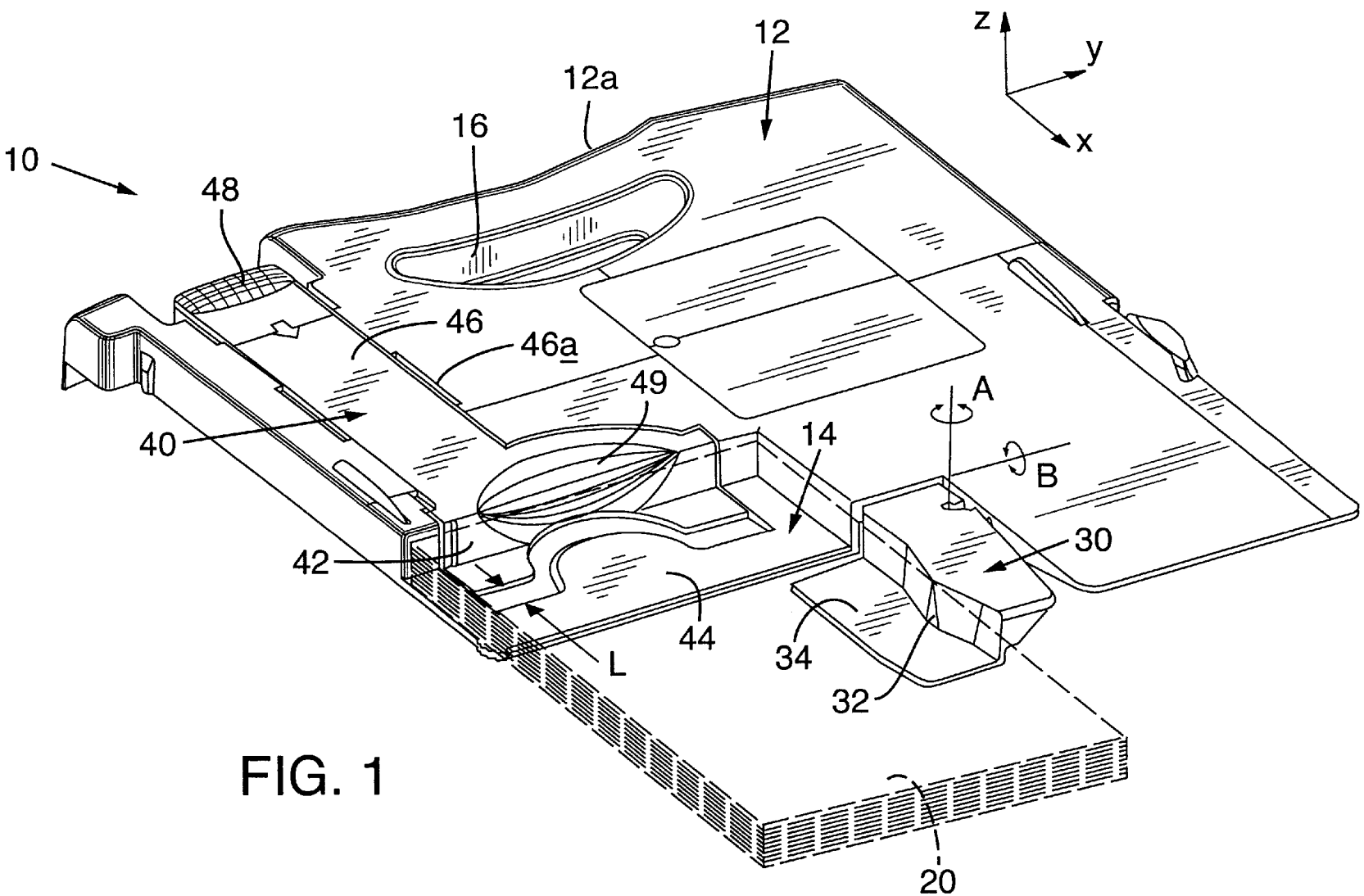
FIG. 1 is an isometric view of a media loader insert constructed in accordance with the present invention, a small-size media stack being shown in dashed lines.
Figure 2:
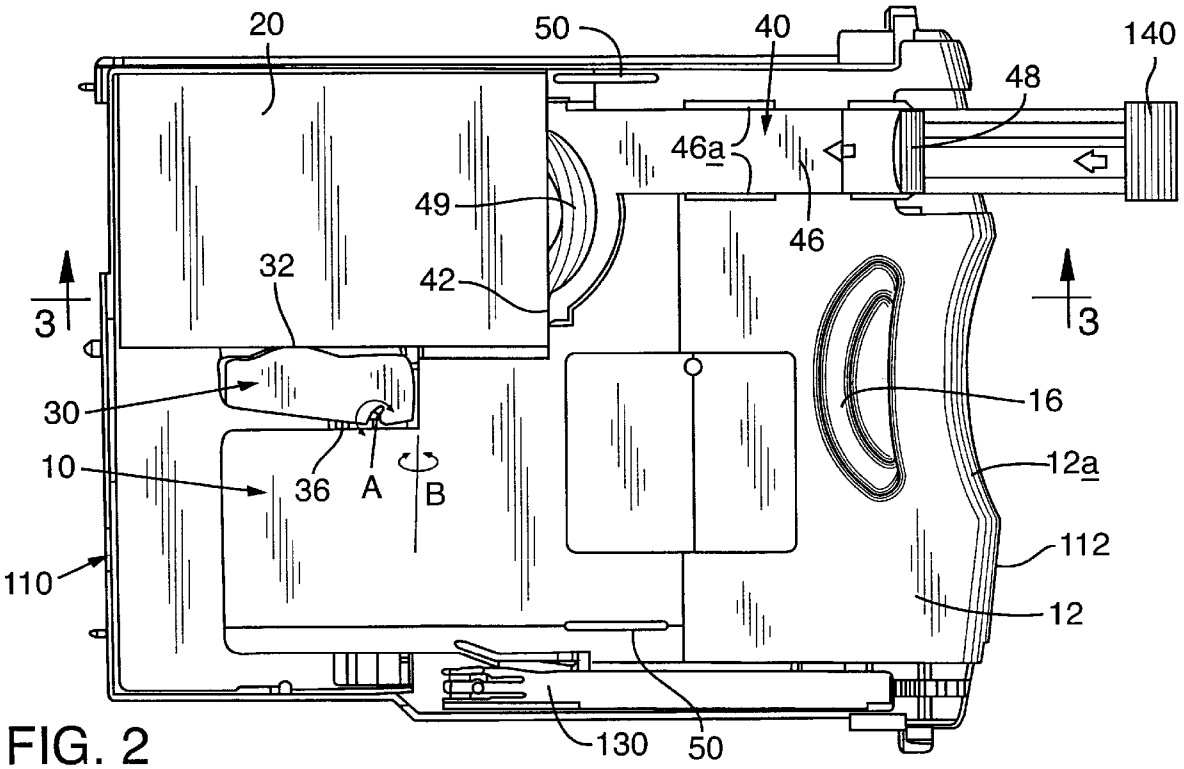
FIG. 2 is a plan view of the media loader insert of FIG. 1, the media loader insert having been inserted into a printer input tray in accordance with another aspect of the invention.
Figure 3:
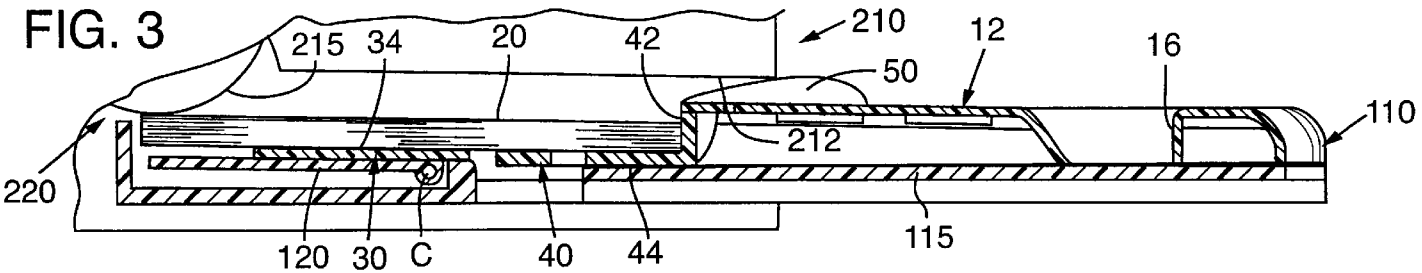
FIG. 3 is a sectional side view of the media loader insert and input tray of FIG. 2, the input tray having been inserted into a printer to demonstrate operation of the input tray.

Referring to FIGS. 1 through 3, a media loader insert 10 is shown, such media loader insert being configured to accommodate receipt of small-size media for printing. Accordingly, the media loader insert includes a generally rectangular, planar body 12 with a media receptacle 14 sized to receive a small-size media stack 20 (typically A6 media or Hagaki media) such that small-size media sheets may be automatically fed or picked, through a printer's input port. The media holder is adapted to maintain the media sheets in the depicted stacked relationship so as to reduce difficulties typically associated with the input of small-size media, namely media skew.

As indicated in FIG. 2, media loader insert 10 is configured for fitted placement in a printer's input tray 110, the media loader insert typically being characterized by a profile which corresponds that of the input tray. It will be appreciated, for example, that body 12 has a width which corresponds to the width of letter-size paper, a length which corresponds somewhat to the length of letter-size paper, and a depth which corresponds somewhat to the depth of the input tray. In fact, body 12 has a rear edge 12*a* which mimics the contour of the input tray's rear edge 112 so as to provide a visual cue to aid in alignment of media loader 10 within input tray 110.

Upon placement of the media loader insert in input tray 110, the input tray's side edge stop 130 is adjusted to engage a side edge of the media loader insert in a manner similar to the manner in which the side stop would engage the side edge of a letter-size media stack. This typically means that the side edge stop will engage a central region of the media loader insert's side edge. This is in contrast to the rearward region of the small-size media stack which would be engaged by the input tray's side edge stop if the media was placed directly in the input tray. Side edge stop 130 may be spring-biased toward engagement with media loader insert 10, thus urging the media loader insert into engagement with the opposite side edge of the input tray, and into a desired, non-skewed orientation. Alternatively, the side edge stop may be manually adjusted, and held in position adjacent the media loader insert via another suitable journaling mechanism.

Similarly, the input tray's rear edge stop 140 may be configurable to engage a rear edge of the media loader input in a manner similar to the manner in which the rear edge stop would engage a letter-size media stack. Typically, the rear edge stop will be manually adjusted, and held in position adjacent the media loader insert via a suitable journaling mechanism.

The media loader insert is placed in the input tray using a recessed handle 16, which also typically is formed in body 12. As will be appreciated upon reading further, the media loader insert is intended to receive media after placement of the media loader insert in the input tray, the input tray serving to define the remaining retention boundaries for the small-size media stack. The media stack thus is closely held in a predetermined feed orientation, which orientation is selected to prevent media skew.

For the purpose of simplifying this disclosure, FIG. 1 includes an illustration of orthogonal axes, such axes being useful in describing use of the depicted media loader insert. The indicated X axis corresponds to the media feed direction, the positive direction being "forward" or "downstream" in the direction of media feed. The Y axis corresponds to media width, the positive direction being toward the "right" as viewed from the leading edge of the media in the orientation depicted in FIG. 1. The Z axis corresponds to media stack height and is perpendicular to the plane of media, with the positive direction being "up" from the media stack in the orientation depicted in FIG. 1.

Referring now to FIGS. 1 and 2, it will be appreciated that media loader insert 10 is adaptable to accommodate variations in media size, though such variations typically are relatively small, on the order of approximately 5-mm. The media loader insert thus includes a width adjuster 30, which adjusts the position of a media-engaging surface 32, and a length adjuster 40, which adjusts the position of a media-engaging surface 42. Width adjuster 30 engages a right-side edge of the small-size media stack, and thus includes a media-engaging surface 32 which extends generally parallel to the X axis. Length adjuster 40 engages a rear edge of the small-size media stack, and thus includes a media-engaging surface 42 which extends generally parallel to the Y axis.

Media-engaging surface 32 is contoured to accommodate contact between the media-engaging surface and the side edge of the small-size media stack. Preferably, media-engaging surface 32 will engage a central region of the side edge of small-size media stack 20, thus reducing the potential for undesirable media skew. The small-size media stack is further supported in the aforementioned central region by an adjustable floor 34, which extends somewhat normally from media-engaging surface 32 to support the small-size media stack from below. It will be appreciated that adjustable floor 34 need not extend entirely across the media, but rather may support only a portion thereof.

As indicated, width adjuster 30 is pivotal about a vertical axis A which extends parallel to the Z axis depicted in FIG. 1. Media-engaging surface 32 thus is pivotally adjustable along the Y axis to ensure contact between media-engaging surface 32 and the side edge of small-size media stack 20. In the depicted embodiment, media-engaging surface 32 adjusts approximately 5-mm in the area which contacts the small-size media stack. Typically, media-engaging surface 32 is spring-biased in the negative Y direction, toward engagement with the small-size media stack via hinge assembly 36. Such spring bias assists in maintaining proper media orientation, and thus in reducing media skew.

In the present embodiment, width adjuster 30 also is pivotally adjustable about a horizontal axis B which extends parallel to the Y axis. Axis B, it will be noted, extends generally along a rearward end of the width adjuster to provide for pivotal adjustment of adjustable floor 34. Floor 34 adjusts approximately 15-mm vertically adjacent the forward end thereof. By providing for such pivotal adjustment, it is possible to keep the width adjuster engaged with the side edge of the media stack while the elevation of the media stack is changed. It also is possible to engage the small-size media stack nearer to the forward edge of the media without affecting support of the media by the input tray, and thus without compromising normal media feed as demonstrated in FIG. 3. Floor 34 also may be spring-biased in the positive Z direction, toward engagement with the small-size media stack via hinge assembly 36.

Referring still to FIGS. 1 and 2, it will be noted that length adjuster 40 employs a generally planar media-engaging surface 42. Preferably, media-engaging surface 42 engages a substantial portion of the rearward edge of small-size media stack 20, typically in a central region thereof so as to reduce the potential for undesirable media skew. The small-size media stack is further supported along its rearward edge by a floor 44, which extends somewhat normally from media-engaging surface 42 to support the small-size media stack from below. It will be appreciated that floor 44 need not extend entirely across the media, but does extend entirely across the media in the depicted embodiment. Floor 44 also extends approximately ¼ to ⅓ of the length of the media, as shown.

As will be appreciated from review of the drawings, length adjuster 40 is linearly adjustable along the X axis to accommodate variations in the size of media used. The length adjuster thus includes a glide element 46 which travels along a track defined by tabs 46*a*. The length adjuster is configured to travel a distance L, which typically is on the order of approximately 5-mm.

In the depicted embodiment, the length adjuster is manually adjusted using a hand grip 48 which is located near the rearward end of the media loader, thus providing ready access to the user. The length adjuster maintains its selected position due to frictional forces between glide element 46 and track 46*a*. Alternatively, media-engaging surface 42 may be biased in the positive X direction, toward engagement with the small-size media stack to assist in maintaining proper media alignment. A recess 49 provides the user with access to the media stack when inserting/removing media from the modified input tray.

Accordingly, it will be appreciated that media loader insert 10 fits within input tray 110 to define a modified media receptacle space which is specially configured to receive small-size media. Media-engaging surface 32 is adjustable relative to the input tray's left side to define the width of the modified media receptacle space. Media-engaging surface 42 is adjustable relative to the input tray's front edge to define the length of the modified media receptacle space. The left and forward walls of input tray 110 respectively define fixed left and forward limits of the modified media receptacle space. Media within the modified media receptacle space is supported from below by width adjuster floor 34 and length adjuster floor 44. A media elevator 120, in turn, supports width adjuster floor 34 and provides supplemental support for the media stack (FIG. 3).

Referring now to FIGS. 1 through 3, it will be noted that media loader insert 10 includes registration ridges 50 which extend upwardly from opposite sides of body 12 for use in registering the media loader insert within printer 210. The media loader insert, it will be recalled, is inserted into input tray 110, which is configured for placement in the printer's input tray registration channel 212. The input tray also may be fitted with registration ridges, or other fitment mechanism as will be appreciated by those skilled in the field of printer design. As indicated above, the media loader insert is fixed within the input tray using adjustable side edge stop 130, and using adjustable rear edge stop 140. In fact, in the present embodiment, the length adjuster is cooperatively linked with the rear edge stop to accommodate adjustment of the rear edge stop.

As indicated in FIG. 3, the registration ridges are elongate, generally planar projections oriented parallel to the X axis. Each ridge extends toward the back of the media loader insert from a central position just rearward of the media-engaging surface 42. In the depicted embodiment, the ridge has a gently sloped leading ramp portion configured to engage registration channel 212 upon placement of the input tray within an input-tray-receiving aperture of printer 210. With the ridges so received, the media loader insert is held in place along the Z axis. Furthermore, in addition to being constrained against lateral movement by the input tray's side edge stop, it is constrained against yaw misalignment by contact between the ridges and the registration channel.

FIG. 3 also shows how media loader insert 10 rests on input tray floor 115. The lower surface of length adjuster floor 44, for example, directly contacts the upper surface of input tray floor 115. The side walls of the media loader insert also typically rest on the input tray floor, creating a stable support structure. Length adjuster floor 44 is relatively thin, and thus supports small-size media stack 20 at a level only slightly above input tray floor 115, preserving much of the capacity of the input tray.

As will be noted, media 20 extends beyond the forward end of length adjuster floor 44, typically onto width adjuster floor 34, which is supported by a media elevator 120. Elevator 120, it will be understood, is formed within input tray 110 to selectively raise the leading edge of a media stack within the input tray into contact with a pick roller 215. The media loader insert is adapted to utilize the media elevator by placing the leading edge of the small-size media onto the media elevator as shown. Pick roller 215 thus may be used to pull the media into the printer's input port 220 for printing.

In the depicted embodiment, media elevator 120 is pivotally hinged to the input tray floor, the media elevator thus being capable of pivot about an axis C, which is generally parallel to the Y axis. Preferably, the media elevator will pivot cooperatively with width adjuster floor 34, which rests on the media elevator and pivots about an axis B, also generally parallel to the Y axis. Typically, the media elevator is spring-biased to pivot upward (clockwise in FIG. 3) to urge media toward pick roller 215. Although a single pick roller is shown, those skilled will understand that multiple, closely-spaced pick rollers may be used to further reduce the risk of media skew.

Therefore, a user may employ the depicted media loader insert to reduce skew when printing on small-size media such as A6 media, Hagaki media, or the like. The user simply pulls out the input tray, removes any media from the input tray and places media loader insert 10 within the input tray. Media loader 10 then is secured in place using the input tray's adjustable side edge stop and adjustable rear edge stop as described above. The media loader insert may be positioned using matching rear contours of the media loader and the input tray. Upon securing the media holder insert in place, small-size media may be placed in recessed media support region 14. The media is maintained in its proper orientation using width adjuster 30 and length adjuster 40. Finally, the input tray may be re-inserted into the registration channel of the printer such that media may be picked from the media loader insert within the input tray.

While the present invention has been shown and described with reference to the foregoing operational principles and embodiments, it will be apparent to those skilled in the art that other changes in form and detail may be made without departing from the spirit and scope of the invention as defined in the appended claims.

We claim:

1. In a printer having an input tray, a media loader insert comprising:

an insert body which defines a reduced-size media receptacle, the insert body being sized to securely fit within the input tray; and a width adjuster adjacent the reduced-size media receptacle, the width adjuster being positioned centrally along a side edge of the reduced-size media receptacle to centrally engage a side edge of media within the reduced-size media receptacle, thereby urging such media into engagement with a side wall of the input tray and reducing media skew.

2. The media loader insert of claim 1, wherein the input tray includes a side edge stop configured to selectively engage letter-size media contained within the input tray, and wherein the insert body has a width corresponding to letter-size media width.

3. The media loader insert of claim 1, wherein the width adjuster includes an adjustable media-engaging surface configured selectively to engage the side edge of media within the reduced-size media receptacle.

4. The media loader insert of claim 3, wherein the media-engaging surface is biased toward engagement with the side edge of media within the reduced-size media receptacle to urge such media into engagement with the side wall of the input tray.

5. The media loader insert of claim 1, wherein the width adjuster includes an adjustable floor configured to support media within the reduced-size media receptacle from below.

6. The media loader insert of claim 5, wherein the width adjuster floor is free to rotate upwardly to accommodate pick-up of media within the reduced-size media receptacle.

7. The media loader insert of claim 1, wherein the width adjuster includes a media-engaging surface which is biased to pivot about a first axis to engage the side edge of media within the reduced-size media receptacle, and wherein the width adjuster includes a floor which is pivotal about a second axis, transverse to the first axis, to support media within the reduced-size media receptacle from below.

8. The media loader insert of claim 7, wherein the input tray includes a media elevator configured to selectively raise a leading edge of media in the input tray, and wherein, by movement of media in the input tray, the width adjuster floor is configured to move with the media elevator to selectively raise media within the reduced-size media receptacle.

9. The media loader insert of claim 1, which further comprises a length adjuster adjacent the reduced-size media receptacle, the length adjuster being positioned centrally along a rear edge of the reduced-size media receptacle to selectively centrally engage a rear edge of media within the reduced-size media receptacle.

10. The media loader insert of claim 9, wherein the input tray includes an adjustable rear edge stop, the length adjuster being cooperatively linked with the adjustable rear edge stop to accommodate adjustment of the length adjuster via the adjustable rear edge stop of the input tray.

11. The media loader insert of claim 1, wherein the insert body has a trailing edge contoured to mimic a contour of the input tray, thereby providing a visual cue to assist in loading the media loader insert into the input tray.

12. A media loader insert for use in a printer with an input tray, the tray having a fixed wall and a floor for receiving and holding media of a first size for feeding to the printer, the media loader insert comprising:

an insert body including a reduced-size media receptacle for receiving media that is reduced in size relative to the media of the first size, the insert body configured to be inserted into the input tray and to rest on the floor of the input tray to provide reduced-size media to the printer, the insert body further configured to be removed from the input tray for loading with the reduced-size media; and a media-engaging surface along one side of the reduced-size media receptacle, the media-engaging surface moving to urge reduced-size media into engagement with a side wall of the input tray to accommodate variations in media size.

13. A printer comprising:

an input tray configured to receive letter-size media for insertion through an input port for printing, the input tray including an adjustable side edge stop configured to selectively engage a side edge of letter-size media within the input tray to urge such letter-size media into engagement with an opposite side edge of the input tray, and including a media elevator configured to selectively raise a leading edge of media in the input tray; and a media loader insert including an insert body with a reduced-size media receptacle configured to receive small-size media therein, a width adjuster configured to selectively engage a side edge of small-size media within the reduced-size media receptacle, and a length adjuster configured to selectively engage a rear edge of small-size media within the reduced-size media receptacle;

the width adjuster including a pivotal media-engaging surface positioned along a side edge of the reduced-size media receptacle and biased to pivot about a first axis to selectively engage the side edge of small-size media within the reduced-size media receptacle to urge such small-size media into engagement with the opposite side edge of the input tray, and a pivotal width adjuster floor configured to pivot upwardly with the media elevator about a second axis, transverse to the first axis, to selectively raise media within the reduced-size media receptacle;

the length adjuster including an adjustable media-engaging surface positioned along a rear edge of the reduced-size media receptacle to selectively engage a rear edge of media within the reduced-size media receptacle; and the media loader insert having a width corresponding to letter-size media width to accommodate removable placement of the media loader insert within the input tray with the adjustable side edge stop engaging the media loader insert to urge such media loader insert into engagement with the opposite side edge of the input tray to secure the media loader insert in place.

14. A printer comprising:

an input tray configured to receive letter-size media for insertion through an input port for printing, the input tray including an adjustable side edge stop configured to selectively engage a side edge of letter-size media contained within the input tray to urge such letter-size media into engagement with an opposite side edge of the input tray; and a media loader insert including an insert body with a reduced-size media receptacle, and a width adjuster with an adjustable media-engaging surface positioned along a side edge of the reduced-size media receptacle to selectively engage a side edge of media within the reduced-size media receptacle, the media loader insert having a width corresponding to letter-size media width to accommodate removable placement of the media loader insert within the input tray with the adjustable side edge stop engaging the media loader insert to urge such media loader insert into engagement with the opposite side edge of the input tray to secure the media loader insert in place, media within the reduced-size media receptacle thus being urged into engagement with the opposite side edge of the input tray to reduce media skew.

15. The printer of claim 14, wherein the media-engaging surface of the width adjuster is biased toward generally central engagement with the side edge of media within the reduced-size media receptacle.

16. The printer of claim 14, wherein the input tray further includes a media elevator configured to selectively raise a leading edge of media in the input tray, and wherein the width adjuster further includes a floor which supports media within the reduced-size media receptacle from below, the width adjuster floor being configured to move with the media elevator to selectively raise media within the reduced-size media receptacle.

17. The printer of claim 14, wherein the media loader insert further includes a length adjuster adjacent the reduced-size media receptacle, the length adjuster being positioned along a rear edge of the reduced-size media receptacle to selectively engage a rear edge of media within the reduced-size media receptacle.

* * * * *